US009679468B2

(12) United States Patent
Piccolo, III

(10) Patent No.: US 9,679,468 B2
(45) Date of Patent: Jun. 13, 2017

(54) DEVICE AND APPARATUS FOR SELF-TESTING SMOKE DETECTOR BAFFLE SYSTEM

(71) Applicant: Tyco Fire & Security GmbH, Neuhausen am Rheinfall (CH)

(72) Inventor: Joseph Piccolo, III, Fitzwilliam, NH (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 322 days.

(21) Appl. No.: 14/257,515

(22) Filed: Apr. 21, 2014

(65) Prior Publication Data

US 2015/0302727 A1 Oct. 22, 2015

(51) Int. Cl.

| | |
|---|---|
| ***G08B 29/00*** | (2006.01) |
| ***G08B 29/14*** | (2006.01) |
| ***G08B 17/107*** | (2006.01) |
| *G08B 17/113* | (2006.01) |

(52) U.S. Cl.
CPC ..... *G08B 29/145* (2013.01); *G08B 17/107* (2013.01); *G08B 17/113* (2013.01)

(58) Field of Classification Search
CPC ..... G08B 29/145; G08B 17/113
USPC ..... 340/630, 628, 514, 517, 506
See application file for complete search history.

(56) References Cited

U.S. PATENT DOCUMENTS

| | | | | |
|---|---|---|---|---|
| 4,099,178 | A | 7/1978 | Ranney et al. | |
| 4,595,914 | A | 6/1986 | Siegel | |
| 4,623,788 | A | 11/1986 | Kern et al. | |
| 4,870,394 | A | 9/1989 | Corl et al. | |
| 4,965,556 | A | 10/1990 | Brodecki et al. | |
| 5,149,921 | A | 9/1992 | Picado | |
| 5,231,378 | A * | 7/1993 | Dennis | G08B 17/107 250/574 |
| 5,400,014 | A | 3/1995 | Behlke et al. | |
| 5,568,129 | A | 10/1996 | Sisselman et al. | |
| 5,621,394 | A | 4/1997 | Garrick et al. | |
| 5,625,346 | A | 4/1997 | Shim et al. | |
| 5,798,701 | A | 8/1998 | Bernal et al. | |
| 5,821,866 | A | 10/1998 | Bernal et al. | |

(Continued)

FOREIGN PATENT DOCUMENTS

| | | |
|---|---|---|
| EP | 0 213 383 A1 | 3/1987 |
| EP | 1224641 B1 | 8/2000 |

(Continued)

OTHER PUBLICATIONS

International Search Report and Written Opinion of the International Searching Authority, mailed on Jul. 16, 2015, from counterpart International Application No. PCT/IB2015/052788, filed on Apr. 16, 2015.

(Continued)

*Primary Examiner* — Daryl Pope
(74) *Attorney, Agent, or Firm* — HoustonHogle LLP

(57) ABSTRACT

A device and method for self-testing fire detection device uses a blockage sensor system to determine if a detection chamber is blocked due to dust, for example. The system includes at least one pathway light source for shining the light into pathways of a baffle system and one or more detectors for detecting the light. The blockage sensor system detects obstructions in the pathways by analyzing how light propagates through the pathways.

19 Claims, 7 Drawing Sheets

(56) References Cited

U.S. PATENT DOCUMENTS

| | | | | |
|---|---|---|---|---|
| 6,225,910 | B1 | 5/2001 | Kadwell et al. | |
| 6,313,744 | B1 | 11/2001 | Capowski et al. | |
| 6,326,897 | B2 | 12/2001 | Kadwell et al. | |
| 6,653,942 | B2 | 11/2003 | Kadwell et al. | |
| 6,737,967 | B2 | 5/2004 | Farley | |
| 6,756,906 | B2 | 6/2004 | Bernal et al. | |
| 6,769,285 | B2 | 8/2004 | Schneider et al. | |
| 6,950,016 | B2 | 9/2005 | Farley | |
| 7,034,702 | B2 | 4/2006 | Thomas et al. | |
| 7,106,187 | B2 | 9/2006 | Penney et al. | |
| 7,158,023 | B2 | 1/2007 | Kaiser | |
| 7,167,088 | B2 | 1/2007 | Farley | |
| 7,167,098 | B2 | 1/2007 | Siber et al. | |
| 7,242,288 | B2 | 7/2007 | Kaiser et al. | |
| 7,463,159 | B2 | 12/2008 | Hess et al. | |
| 7,483,139 | B2 | 1/2009 | Powell | |
| 7,852,227 | B2 | 12/2010 | Pepper et al. | |
| 8,228,182 | B2 | 7/2012 | Orsini et al. | |
| 2001/0020899 | A1* | 9/2001 | Kadwell | G08B 17/107 340/630 |
| 2002/0128783 | A1 | 9/2002 | Marcu et al. | |
| 2003/0011770 | A1* | 1/2003 | Cole | G01N 21/53 356/338 |
| 2005/0100478 | A1 | 5/2005 | Harvey | |
| 2005/0217872 | A1 | 10/2005 | Oh et al. | |
| 2006/0202847 | A1 | 9/2006 | Oppelt et al. | |
| 2009/0021729 | A1* | 1/2009 | Iguchi | G08B 17/107 356/246 |
| 2010/0328082 | A1* | 12/2010 | Danz | G08B 17/10 340/589 |
| 2012/0286946 | A1 | 11/2012 | Karl et al. | |
| 2013/0093594 | A1 | 4/2013 | Brigham et al. | |

FOREIGN PATENT DOCUMENTS

| | | | |
|---|---|---|---|
| EP | 1224641 | B1 | 5/2003 |
| EP | 2 028 631 | A2 | 2/2009 |
| EP | 2 330 577 | A1 | 6/2011 |
| WO | 2012/041580 | A1 | 5/2012 |

OTHER PUBLICATIONS

International Preliminary Report on Patentability, mailed Nov. 3, 2016, from International Application No. PCT/IB2015/052788, filed Apr. 16, 2015. Eight pages.

* cited by examiner

DEVICE AND APPARATUS FOR SELF-TESTING SMOKE DETECTOR BAFFLE SYSTEM

BACKGROUND OF THE INVENTION

Fire alarm systems are often installed within commercial, residential, educational, or governmental buildings, to list a few examples. These fire alarm systems typically include control panels and fire detection devices, which monitor the buildings for indicators of fire. In one example, the fire detection devices are individually addressable smoke detectors that are part of a network. The detectors send event data to the control panel, which analyzes the received event data. In more detail, the smoke causes a change at the detector, such as an increase in a scatter light signal, which is sent to the panel as an event and which after processing by the panel will cause an alarm if the smoke exceeds a preprogrammed threshold.

In another example, the fire alarm system is comprised of standalone or independent fire detection devices. This type of system is often implemented in residential buildings where there is a smaller area to monitor and building code requirements are more relaxed. While each device operates independently from the other devices of the system, the devices are often interconnected such that if one device is activated into an alarm state, then all of the devices enter the alarm state.

Two common types of fire detection devices are photoelectric (or optical) smoke detectors and ionization smoke detectors. The optical smoke detectors often include a baffle system, which defines a detection chamber, to block ambient light while also allowing air to flow into the detection chamber. The optical smoke detectors further include a smoke detection system within the detection chamber for detecting the presence of smoke. The smoke detection system typically comprises a chamber light source and a scattered light photodetector. When smoke fills the detection chamber it causes the light from the chamber light source to be scattered within the chamber and detected by the scattered light photodetector. Ionization smoke detectors also typically have a detection chamber containing an ionizing radioisotope. When smoke fills the detection chamber, the electronics of the smoke detector detect a change in a current arising from the ionization of the smoke. While ionization smoke detectors also include a baffle system to protect the detection chamber, the baffle system it is typically designed to prevent moisture from entering the detection chamber because it can affect the accuracy of the smoke detector.

Currently, building codes often require that the smoke detectors be tested annually. This annual testing is performed because smoke detectors have a number of different failure points. For example, the electronics or optics of the device can fail. Likewise, the detectors can become so dirty that the baffle systems become clogged. Additionally, it is not uncommon for the smoke detectors to get painted over or for insects or spiders to build nests or webs in the detectors.

The annual testing of the devices is commonly performed by a technician performing a walkthrough test. The technician walks through the building and manually tests each of the fire detection devices of the fire alarm system. In the case of smoke detectors, the technician often uses a special testing device. In one example. The testing device includes an artificial smoke generating apparatus housed within a hood at the end of a pole. The technician places the hood around the fire detection device and the artificial smoke generating device releases artificial smoke near the detector. If the smoke detector is functioning properly, it will trigger in response to the smoke. The technician repeats this process for every smoke detector of the fire alarm system.

On the other hand, self-testing fire detection devices have been proposed. In one specific example, a self-test circuit for a smoke detector periodically tests whether the sensitivity of a scattered light photodetector is within a predetermined range of acceptable sensitivities. If the sensitivity of the scattered light photodetector is out of the predetermined range of acceptable sensitivities, then a fault indication is produced.

SUMMARY OF THE INVENTION

The current method for manually testing fire detection devices of a fire alarm system is very labor intensive. One or more technicians must walk through the building and manually test each fire detection device. This testing is time consuming and can be disruptive to the occupants of the building.

Nevertheless, a problem with current self-testing devices is that the devices do not fully validate the operation of the fire detection devices. That is, the devices only test whether individual components of the devices are working or are within an acceptable range of acceptable sensitivities. It is possible to have a scenario in which a fire detection device "passes" a self-test, but has clogged pathways through the baffle system. In this scenario, the fire detection devices would appear to be fully operational, but in reality, the fire detection device is not able to detect smoke, for example.

In general, the present apparatus and method are directed to self-testing fire detection devices that optically test whether the pathways of the baffle system are free from obstructions and whether the smoke detection system is working properly.

In a first implementation, the self-testing smoke detector includes a blockage sensor system, which includes pathway light sources (e.g., light emitting diodes) and pathway photodetectors to test whether the pathways of the baffle system are free from obstructions.

The blockage sensor system determines if pathways are obstructed by analyzing how light propagates through the pathways. By way of example, if the pathways are free from obstructions, then the light will received by the pathway photodetectors. Alternatively, any pathway photodetector that does not receive light (or receives attenuated light) indicates an obstructed pathway.

In a second implementation, one or more light sources are installed outside the baffle system. During a test of the fire detection device, the perimeter light sources are illuminated to inundate the pathways of the baffle system with light. The light propagates though the pathways and into the detection chamber to be detected such as by the scattered light photodetector within the detection chamber. If the photodetector does not receive any light or the light level is attenuated, then the pathways in the baffle system are determined to be obstructed.

In general, according to one aspect, the invention features a fire detection device in which indicators of fire are detected. Additionally, the device further includes a baffle system surrounding the detection chamber to block light from entering the detection chamber while allowing air from an ambient environment to flow into the detection chamber through pathways. The device also includes a blockage sensor system for detecting obstructions in the pathways.

In embodiments, the blockage sensor system comprises at least one pathway light source for shining the light into one or more of the pathways and a detector for detecting the light. Preferably, the blockage sensor system detects the obstructions by detecting light propagating through the pathways.

In one example, the detector is a scattered light detector for detecting scatter light from smoke in the detection chamber. Alternatively, the detector is a dedicated pathway detector for detecting light from the at least one pathways light sources.

In some embodiments, a controller of the fire detection device determines if one or more of the pathways are obstructed. In one example, the controller is a panel controller. In another example, the controller is a device controller. The controller determines if the one or more of the pathways are obstructed by analyzing how light propagates through the pathways as detected by the blockage sensor system. The controller also compares historical levels of light propagating through the pathways to current levels of light propagating through the one or more pathway to infer a degree of obstruction. In addition, the controller indicates fire detection device cleaning and/or replacement in response to determining that the one or more pathways are obstructed.

Alternatively, or in addition, the blockage sensor system implements a wavelength filter that only allows a specific wavelength or narrow spectral band of light to propagate through the pathways while filtering light at other wavelengths, the light of the specific wavelength being detected by a pathway detector of the blockage sensor system.

In general, according to another aspect, the invention features a method for performing a test of a fire detection device. The method includes blocking light from entering a detection chamber with a baffle system that surrounds a detection chamber of the fire detection device. While the baffle system blocks light from entering the detection chamber, air from an ambient environment is able to flow into the detection chamber through pathways. The method further includes detecting obstructions in the pathways with a blockage sensor system.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms of the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1:
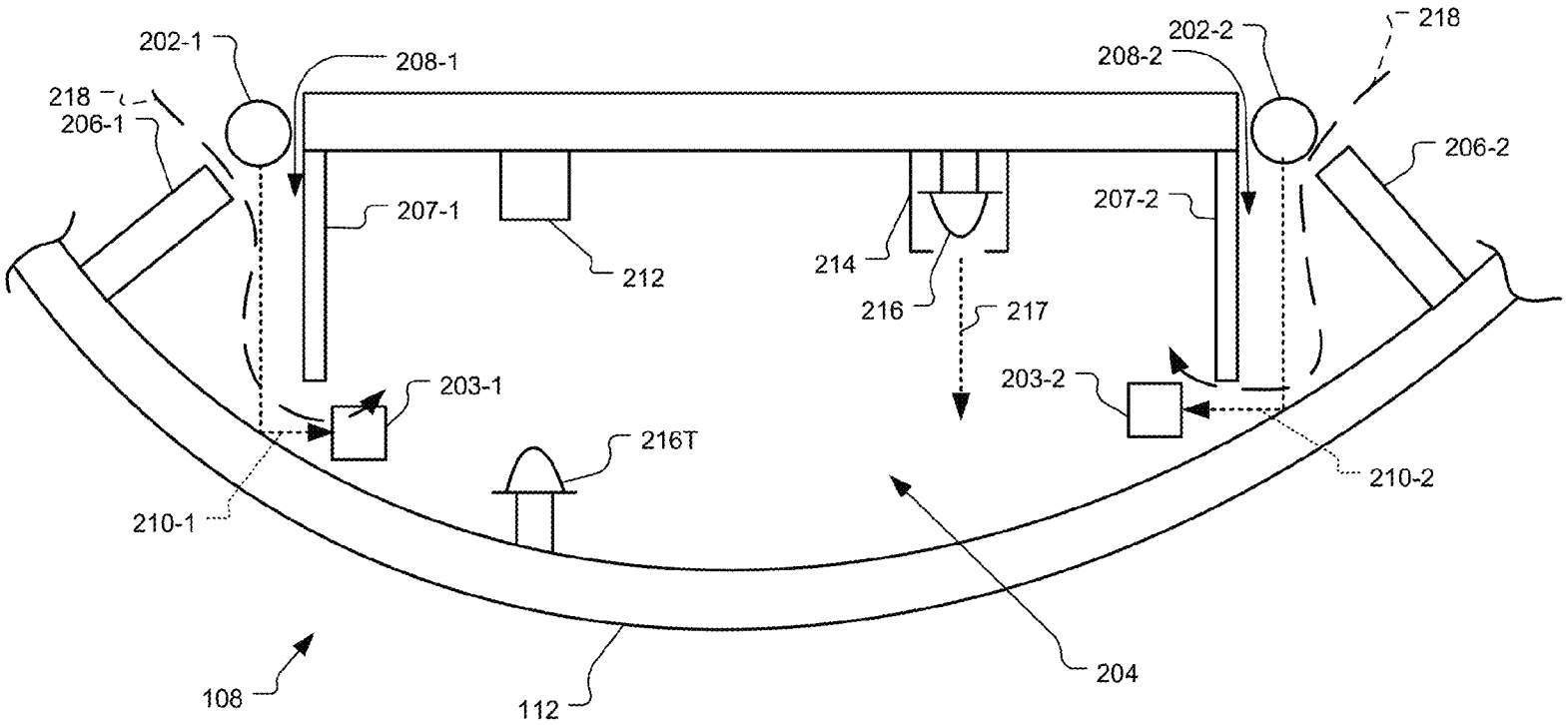
FIG. 1 is a cross-sectional view of a detection chamber of a fire detection device that includes pathway light sources and pathway photodetectors for optically testing for obstructions within pathways of a baffle system.

FIG. 1 is a cross sectional view illustrating of a detection chamber of a fire detection device 108 that includes pathway light sources 202-1, 202-2 and pathway photodetectors 203-1, 203-2 for optically testing for obstructions within pathways 208-1, 208-2 of a baffle system.

In the illustrated example, the fire detection device 108 is a photoelectric smoke detector. Alternative embodiments may implement other types of smoke or gas detectors such as ionization smoke detectors, carbon dioxide detectors, or carbon monoxide detectors, to list a few examples.

The baffle system surrounds the detection chamber and prevents ambient light from entering the chamber or radiation from leaving the chamber, for example. The baffle system comprises s individual baffles (e.g., 206-1, 207-1 and 206-2, 207-2). These individual baffles 206-1, 207-1 and 206-2, 207-2 can also be referred to as walls or vanes, to list a few examples. The baffle system is designed to create the pathways (shown with arrows 208-1, 208-2) that allow air 218 to flow into a detection chamber 204 from the ambient environment while blocking ambient light from entering or radiation from leaving the detection chamber 204.

The blockage sensor system detects obstructions in the pathways 208-1, 208-2. In the illustrated embodiment, the blockage sensor system includes the pathway light sources 202-1, 202-2 and the pathway photodetectors 203-1, 203-2. Typically, the pathway light sources 202-1, 202-2 are light emitting diodes (LEDs). However, alternative embodiments may use other light sources such as fiber optic, fluorescent, or incandescent light sources, to list a few examples. Additionally, the light source could emit light in the visible or non visible wavelengths, e.g., infrared or ultraviolet light.

In the illustrated example, there is one pathway light source and one pathway photodetector for each of the pathways of the baffle system. Together, the pathway light source and pathway photodetector form a light source and photodetector pair. Thus, each pathway of the baffle system includes a light source and photodetector pair. These light source and photodetector pairs enable each pathway of the baffle system to be individually tested for obstructions.

During a self-test of the fire detection device, the pathway light sources 202-1, 202-2 are illuminated. Light (shown as arrows 210-1 and 210-2) generated by the pathway light sources 202-1, 202-2 propagates through the pathways 208-1, 208-2 and is detected by the pathway photodetectors 203-1, 203-2. In some examples, the light sources directly illuminate the corresponding photodetector. However, in the illustrated embodiment, the photodetectors detect light after a few, e.g., one, reflection from a wall.

The fire detection device 108 further includes a smoke detection system within the detection chamber 204. The smoke detection system, in the illustrated embodiment, comprises a scattered light photodetector 212, a chamber light source 216, and a test light source 216T. The light 217 from the chamber light source 216 is directed out of an aperture 214 and into the detection chamber 204. If smoke is present in the detection chamber 204, the light will be scattered by the smoke and detected by the scattered light photodetector 212.

During the self-test of the fire detection device, the test light source 216T is illuminated to test whether the scattered light photodetector 212 is able to detect light. Generally, the test light source 216T is installed directly in line with the scattered light photodetector 212 to maximize the amount of light striking the scattered light photodetector 212.

Figure 2:
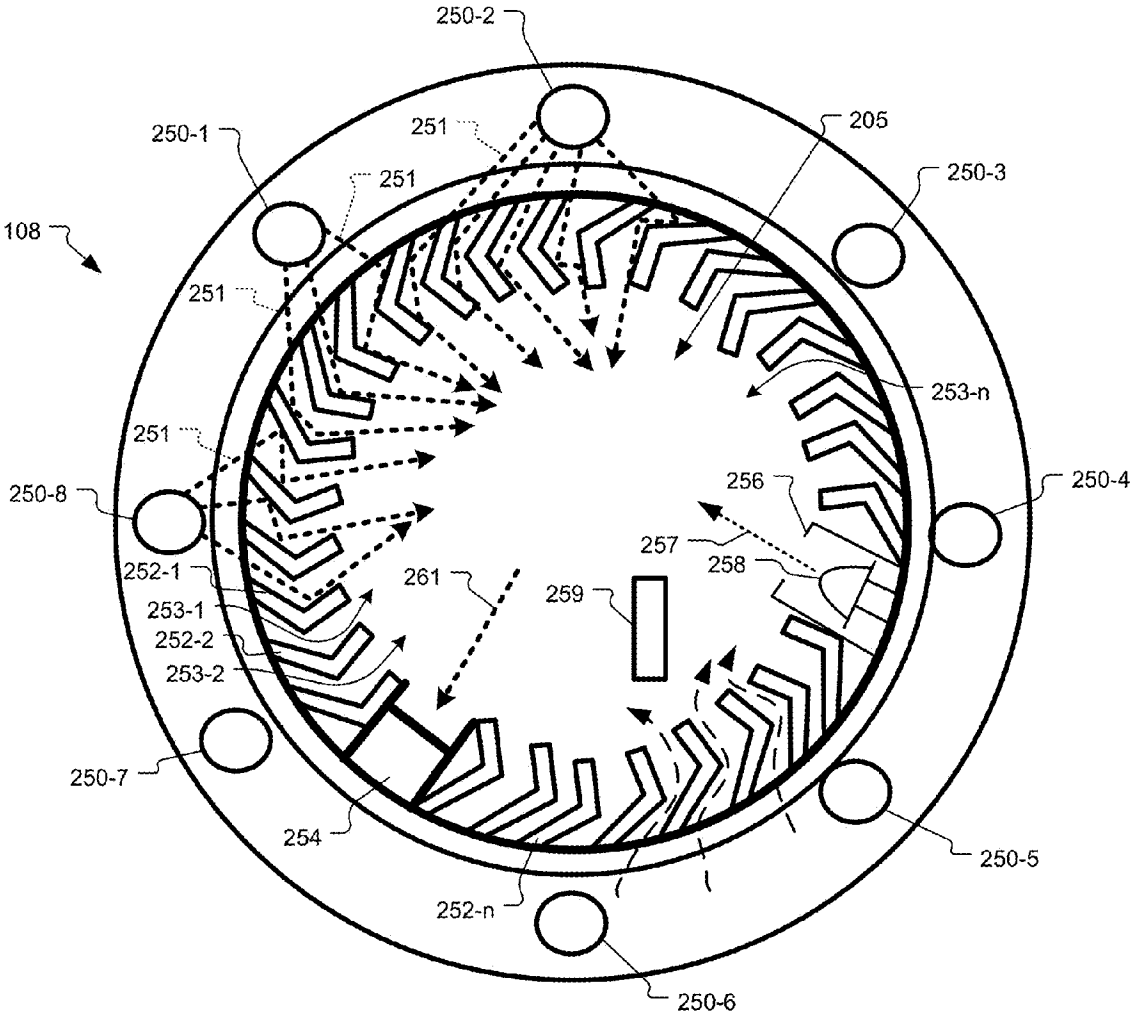
FIG. 2 is a cross-sectional view of a detection chamber according to of an alternative embodiment of the self-testing fire detection device for optically testing for obstructions within pathways of a baffle system.

FIG. 2 shows an alternative embodiment of the self-testing fire detection device 108 for optically testing for obstructions.

In more detail, the smoke detection system detects the presence of smoke within the detection chamber 205 of the device 108. The illustrated smoke detection system comprises at least one chamber light source 258 for generating light 257 and at least one scattered light photodetector 254. The light 257 is directed into the detection chamber 205 through an aperture 256. If smoke is present in the detection chamber, the light is scattered by the smoke and detected by the scattered light photodetector 254. The illustrated example further shows a blocking baffle 259, which prevents the light 257 from having a direct path to the scattered light photodetector 254.

Ambient light is generally blocked from entering the detection chamber 205 by a baffle system. This ensures that any light detected by the scattering light photodetector 254 is due to light scattered by smoke. In the illustrated embodiment, the baffle system comprises a series of cooperating vanes 252-1-252-n, typically made from black plastic, that prevents light from directly entering the chamber and instead absorb and dissipate the light.

Unlike the previous embodiment, which used pathway light sources for each of the pathways, this embodiment includes perimeter light sources 250-1 to 250-8, which are installed about the perimeter of the baffle system. These perimeter light sources 250-1 to 250-8 shine light 251 into multiple pathways 253-1 to 253-n between the vanes, simultaneously.

In one embodiment, one or more pathway photodetectors are used to detect light from the perimeter light sources.

However, in the illustrated embodiment, the blockage sensor system does not utilize pathway photodetectors to detect light. Rather, the scattered light photodetector 254 in the detection chamber 205 detects the light from the perimeter light sources 250-1 to 250-8 and is used as part of the self-test system.

During a self-test, the perimeter light sources 250-1 to 250-8 are illuminated to inundate the pathways 253-1 to 253-n with light (shown as dotted arrows 251). To preserve clarity in the figures, only three of the perimeter light sources (i.e., 250-1, 250-2, and 250-8) are shown to be generating light 251. Upon entering the detection chamber 205, the scattered light photodetector 254 detects at least some of the light (e.g., dotted arrow 261).

In an alternative embodiment, the perimeter light sources 250-1 to 250-8 are illuminated sequentially to test groups of the pathways. By testing one section of the baffle system at a time, information is collected about the degree to which the baffle system is obstructed.

With respect to the embodiments described in FIGS. 1 and 2, a wavelength filter may be applied to the pathways of the baffle system. This filter prevents most wavelengths of light from propagating through the pathways, but is highly reflective for a specific wavelength. This enables light generated at the specific wavelength by the pathway light sources 202-1, 202-2 or perimeter light sources (i.e., 250-1, 250-2, and 250-8) to easily travel into the detection chamber while other wavelengths are filtered.

Figure 3:
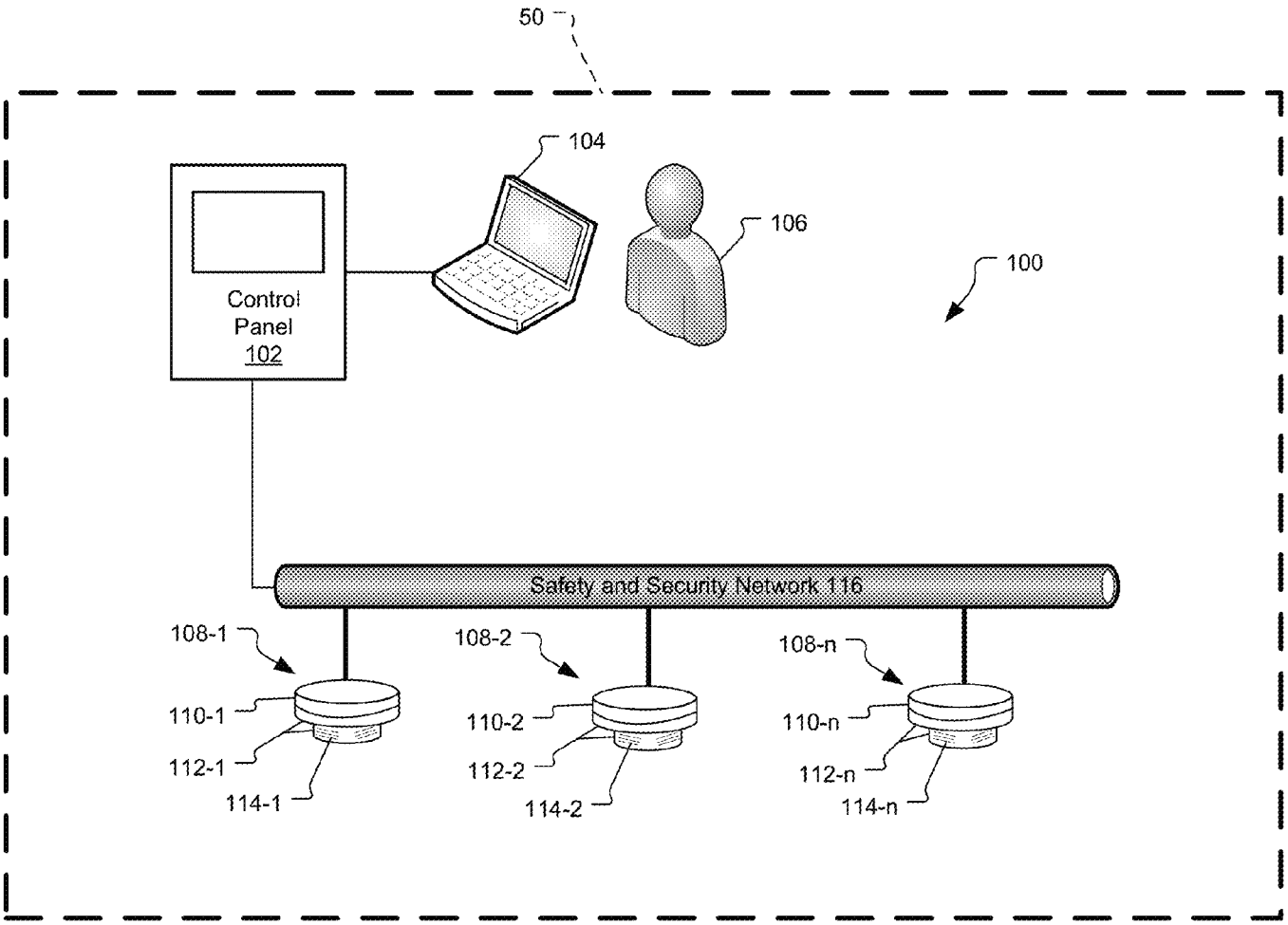
FIG. 3 is a block diagram illustrating a fire alarm system, which includes a control panel and fire detection devices that communicate over an interconnect.

FIG. 3 is a block diagram illustrating a fire alarm system 100 that includes a control panel 102 and fire detection devices 108-1 to 108-n installed within a building 50. The building 50 could be residential, commercial, educational, or governmental. Some examples of buildings include hospitals, warehouses, retail establishments, malls, schools, or casinos, to list a few examples. While not shown in the illustrated example, fire alarm systems typically include other fire detection or annunciation devices such as carbon monoxide or carbon dioxide detectors, temperature sensors, pull stations, speakers/horns, and strobes, to list a few examples.

Typically, the fire detection devices 108-1 to 108-n include housings, which are comprised of base units 110-1 to 110-n and head units 112-1 to 112-n. The head units 112-1 to 112-n generally include the detection components (e.g., smoke detection system) and the base units typically include the communication components, which enable the fire detection devices 108-1 to 108-n to communicate via the safety and security interconnect 116, such as addressable loop or a SLC (signal line circuit), to list a few examples. Additionally, the head units 112-1 to 112-n further include vents or ports 114-1 to 114-n to allow air to enter the fire protection devices 108-1 to 108-n. The safety and security interconnect 116 supports data and/or analog communication between the devices 108-1 to 108-n and the control panel 102.

The control panel 102 receives event data from the devices 108-1 to 108-n. Typically, the event data include a physical address of the activated device, a date and time of the activation, and at least one analog value directed to smoke levels or ambient temperature detected by the fire detection device. The event data received by the control 102 may be stored in a memory and/or sent to a testing computer 104, where the information is stored in a log file. A technician 106 is then able to review the log file and/or generate reports.

Figure 4:
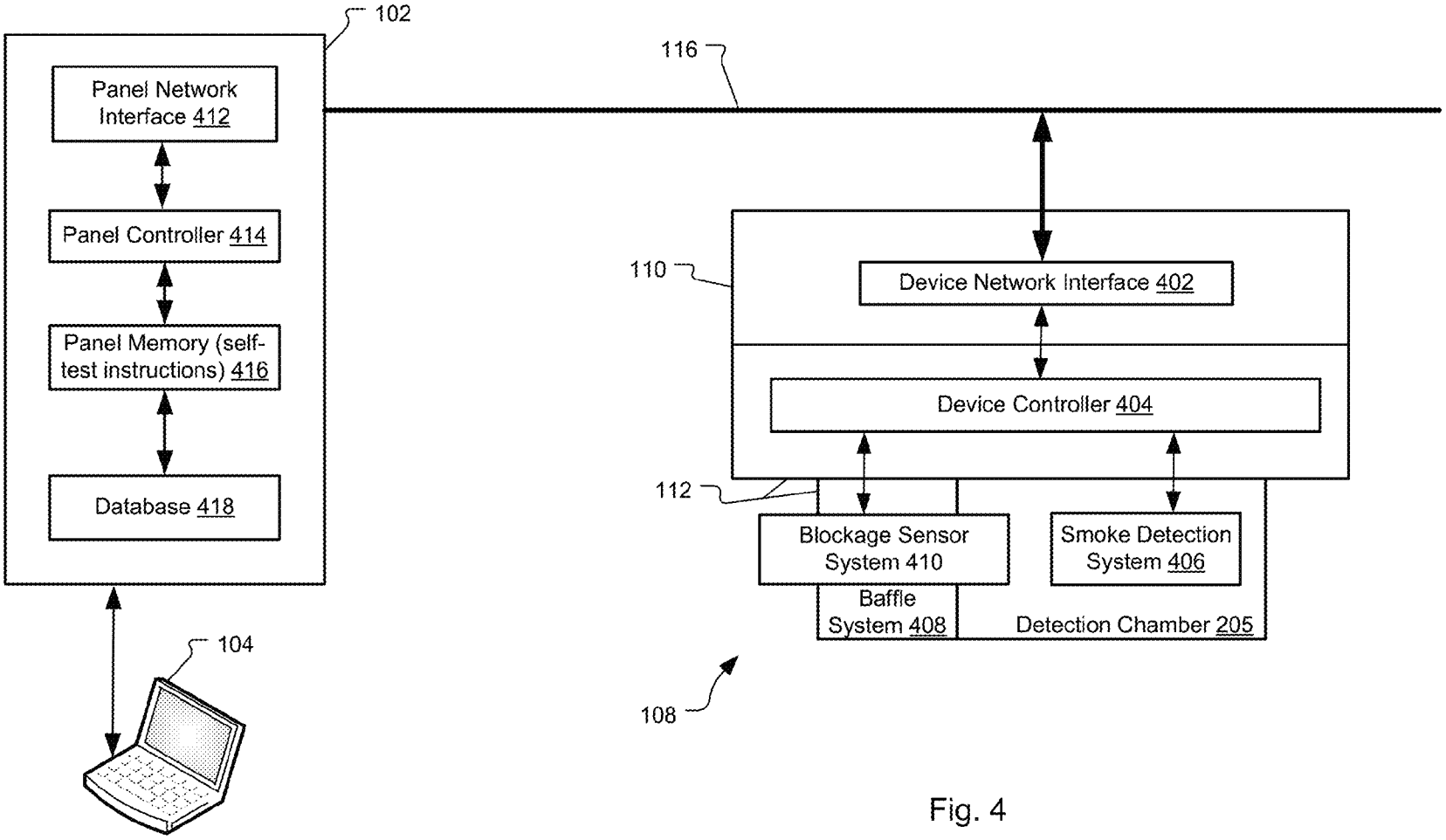
FIG. 4 is a block diagram illustrating the components of the control panel and the fire detection device.

FIG. 4 is a block diagram illustrating the components of the control panel 102 and the fire detection device 108.

A interconnect interface 402 of the fire detection device 108 is housed within the base unit 110. This device interconnect interface 402 enables the fire detection device 108 to communicate with the control panel 102 via the safety and security interconnect 116.

A device controller 404 is housed in the head unit 112 of the fire detection device 108. The device controller 404 communicates with the smoke detection system 406 and the blockage sensor system 410.

The smoke detection system 406 detects if smoke is present in the detection chamber and includes the scattered light photodetector, the chamber light source, and possibly the test light source. The blockage sensor system 410 detects the amount of light propagating through the pathways of the baffle system 408. Preferably, the blockage sensor system 410 comprises at least one pathway or perimeter light source for shining the light into one or more of the pathways and a detector for detecting the light generated by the at least one pathway or perimeter light source.

The control panel 102 includes a panel data interconnect interface 412 to enable the control panel 102 to communicate with the fire detection device 108 via the safety and security data interconnect 116.

In one implementation, the panel controller 414 determines whether the pathways of the baffle system are obstructed. Typically, this is accomplished by comparing the historical levels of light propagating through the pathways as detected by the blockage sensor system, to current levels of light propagating through the one or more pathway to infer a degree of obstruction of the pathways.

While the self-test is typically initiated by a technician 106, the self-test may also be initiated periodically by the control panel 102. In this case, the self-test instructions are stored in panel memory 416. Periodically, the panel controller 414 accesses the self-test instructions. The control panel 102 then sends a test signal to one or more fire detection devices. The results of the self-test performed by the fire detection devices are stored in a database 418. These results may be accessed later at the control panel 102 or transmitted to a testing computer 104 to generate reports.

Figure 5:
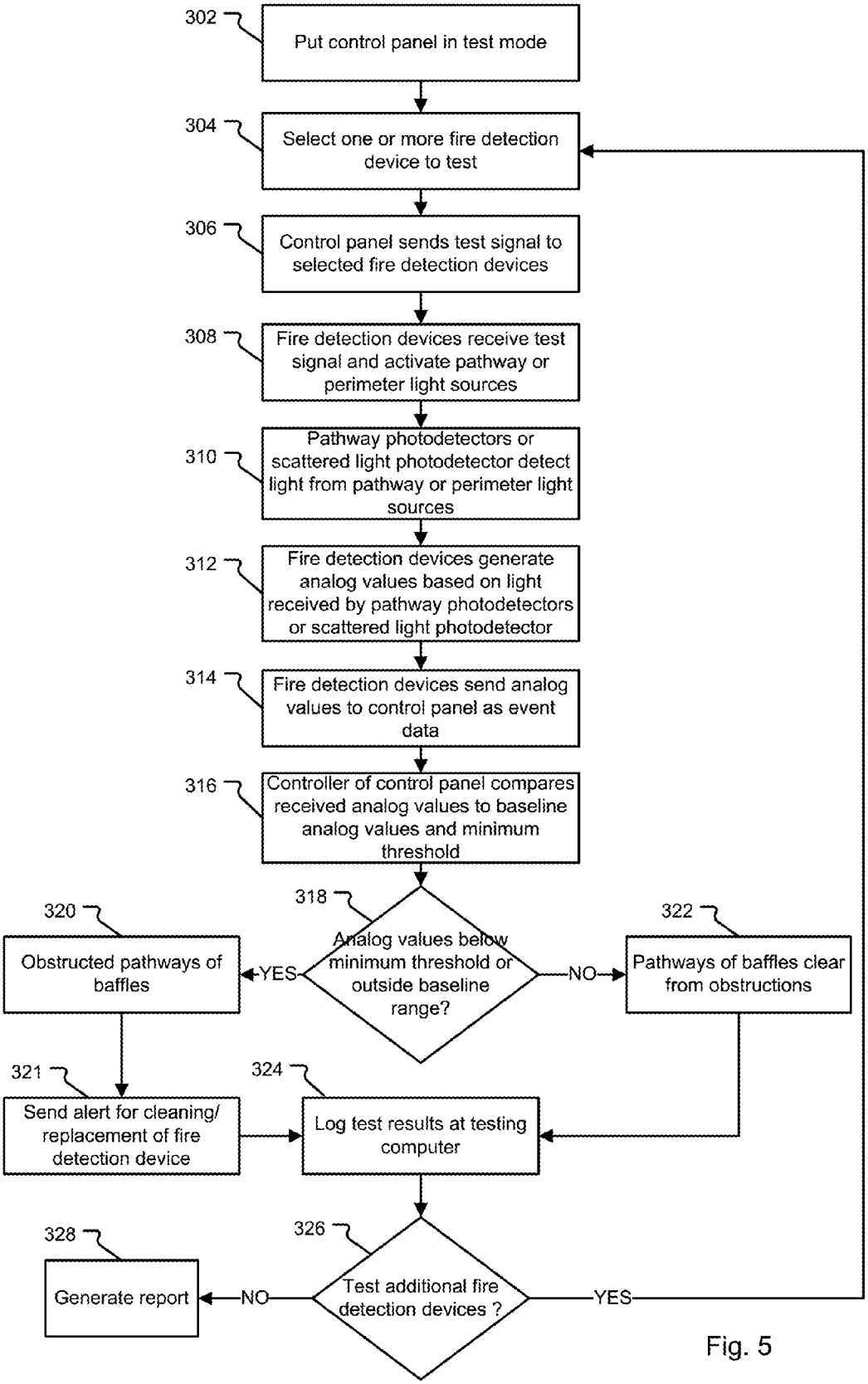
FIG. 5 is a flowchart illustrating the steps performed by the control panel and fire detection device during a self-test.

FIG. 5 is a flowchart illustrating the steps performed by the control panel 102 and fire detection devices 108-1 to 108-n during a self-test.

In the first step 302, the control panel 102 is put into test mode. Typically, test mode silences and/or deactivates audio and visual alarms/warnings during the test. Then, in step 304, the technician 106 (or control panel) selects one or more fire detection devices to test.

The control panel 102 sends a test signal to the selected fire detection devices in step 306. The selected fire detection devices receive the test signal and activate pathway or perimeter light sources in step 308. The pathway photodetectors or scattered light photodetector detect the light in step 310.

Next, the device controllers of the fire detection devices generate analog values based on the amount of light received by pathway photodetectors or scattered light photodetector in step 312. The analog values are sent to the control panel 102 as event data in step 314. In the next step 316, the control panel 102 compares the received analog values to baseline analog values and minimum threshold values. The baseline analog values are historical levels of light propagating through the pathways that are maintained for each detector. Often, the baseline values will change slightly as the detectors age and inevitably accumulate dust or dirt within the detection chambers. Generally, the minimum threshold values are absolute values. The amount of detected light should not fall below the minimum threshold values. Falling below the minimum threshold values indicates that one or more pathways are obstructed.

In the next step 318, the panel controller 414 determines if the analog values are below a minimum threshold or outside an acceptable range of the baseline analog values. If the analog values are below the minimum threshold or the outside of the baseline range, then the panel controller 414 determines that one or more pathways of the fire detection devices are obstructed in step 320. In the next step 321, an alert for cleaning/replacement of fire detection device is sent.

If the analog values are not below the minimum threshold or the outside of the predefined baseline range, then the panel controller 414 102 determines that the pathways are free from obstructions in step 322. The results are then logged at the testing computer 104 in step 324.

If there are no additional fire detection devices to test (i.e., step 326), then a report is generated in step 328. If, however, additional fire detection devices need to be tested, then one or more fire detection devices are selected in step 304.

Figure 6:
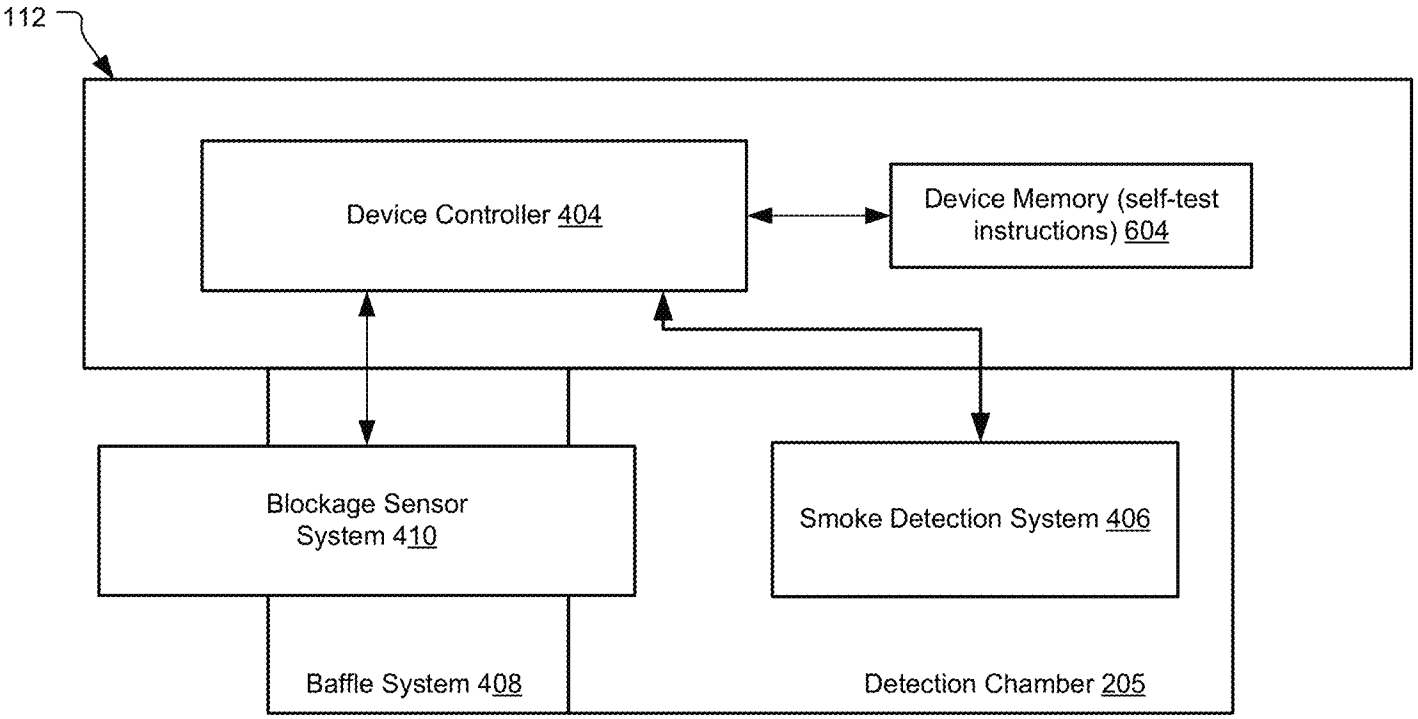
FIG. 6 is a block diagram illustrating an independent or stand alone fire detection device.

FIG. 6 is a block diagram illustrating a head unit 112 of an independent (or standalone) fire detection device 108.

Similar to the embodiment described with respect to FIG. 4, the device controller 404 is housed within the unit 112 and communicates with the smoke detection system 406 and the blockage sensor system 410.

The unit 112 also houses device memory 604, which includes the self-test instructions and stores baseline analog values. Because the fire detection device is a standalone device in the illustrated example, it independently determines when to perform a self-test or performs the self-test in response to operator activation of a test button, for example.

Periodically, the device controller 404 accesses the self-test instructions to initiate a self-test of the fire detection device 108. Rather than sending the event data (with analog values) to the control panel, the device controller 404 determines if one or more of the pathways are obstructed by analyzing how light propagates through the pathways of the baffle system 408.

Figure 7:
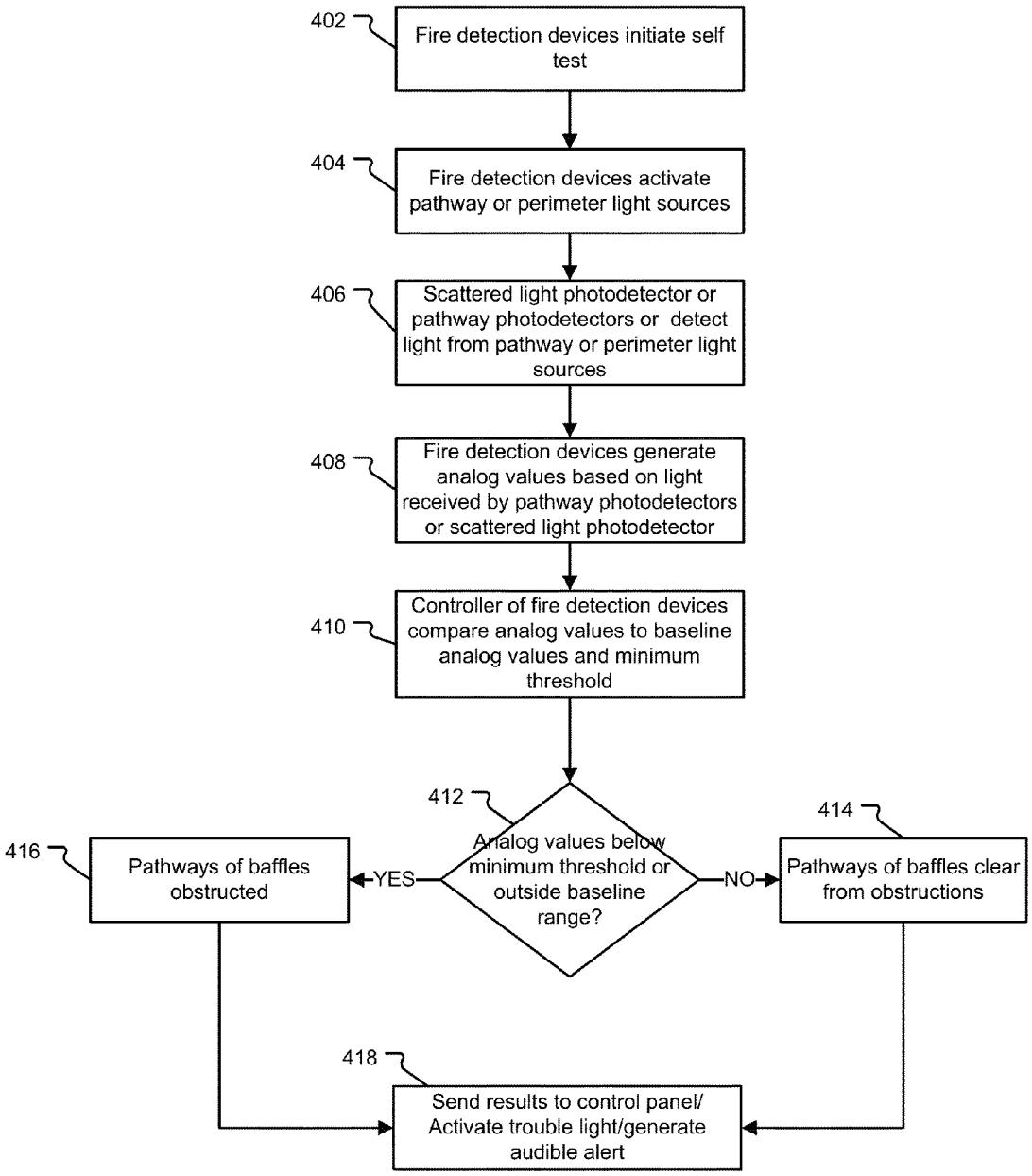
FIG. 7 is a flowchart illustrating the steps performed by the fire detection device when the fire detection device operates independently.

FIG. 7 is a flowchart illustrating the steps performed by the fire detection device when the fire detection device operates independently.

In the first step 402, the fire detection device initiates the self-test. The fire detection device then activates the pathway light sources or perimeter light sources in step 404. The scattered light photodetector or pathway photodetectors detect light from the pathway or perimeter light sources in step 406.

In the next step 408, the device controller 404 generates analog values based on the light received by pathway photodetectors or scattered light photodetector. Next, in step 410, the device 404 controller compares the analog values to baseline analog values and a minimum threshold. The device controller 404 determines if the analog values are below a minimum threshold or outside a baseline range in step 412.

If the analog values are below the minimum threshold or outside the baseline range, then the pathways of the baffle system are determined to be obstructed in step 416. If, however, the analog values are not below the minimum threshold or outside the baseline range, then the pathways of the baffle system are determined to be clear from obstructions in step 414. Then, in step 418, the results are possibly sent to a control panel, a trouble light is activated, and/or an audible alert is generated to signal that the device requires maintenance or repair.

While this invention has been particularly shown and described with references to preferred embodiments thereof, it will be understood by those skilled in the art that various changes in form and details may be made therein without departing from the scope of the invention encompassed by the appended claims.

What is claimed is:

1. A fire detection device for performing self-testing, comprising:

a detection chamber in which indicators of fire are detected;

a baffle system surrounding the detection chamber for isolating the detection chamber by preventing ambient light from entering the chamber while allowing air from an ambient environment to flow into the detection chamber through pathways;

a blockage sensor system for detecting obstructions in the pathways of the baffle system by detecting light propagating through the pathways; and a controller for determining if one or more of the pathways are obstructed by analyzing how light propagates through the pathways as detected by the blockage sensor system and that indicates fire detection device cleaning and/or replacement in response to determining that the one or more pathways are obstructed.

2. A device as claimed in claim 1, wherein the blockage sensor system detects the obstructions by detecting light propagating through the pathways.

3. A device as claimed in claim 1, wherein the blockage sensor system comprises at least one pathway light source for shining the light into one or more of the pathways and a detector for detecting the light.

4. A device as claimed in claim 3, wherein the detector is a scattered light detector for detecting scatter light from smoke in the detection chamber.

5. A device as claimed in claim 3, wherein the detector is a pathway detector for detecting light from the at least one pathways light sources.

6. A device as claimed in claim 1, wherein the controller compares historical levels of light propagating through the pathways to current levels of light propagating through the one or more pathways to infer a degree of obstruction.

7. A device as claimed in claim 1, wherein the controller indicates fire detection device cleaning and/or replacement in response to determining that the one or more pathways are obstructed.

8. A device as claimed in claim 1, wherein the controller is a panel controller located in a control panel.

9. A device as claimed in claim 1 wherein the controller is a device controller located on the device.

10. A device as claimed in claim 1, wherein the blockage sensor system implements a wavelength filter that only allows a specific wavelength of light to propagate through the pathways while filtering light at other wavelengths, the light of the specific wavelength being generated by the blockage sensor system.

11. A method for performing a self-test of a fire detection device, the method comprising:

detecting indicators of fire in a detection chamber that is isolated from an ambient environment and into which air from the ambient environment can flow through pathways of a baffle system surrounding the detection chamber for isolating the detection chamber by preventing ambient light from entering the chamber;

detecting obstructions in the pathways by detecting light propagating through the pathways; and indicating fire detection device cleaning and/or replacement in response to determining that the one or more pathways are obstructed.

12. A method as claimed in claim 11, wherein detecting the obstructions comprises generating light from at least one pathway light source and detecting the light transmitted through the pathways.

13. A method as claimed in claim 12, further comprising detecting the light from the pathways with a scattered light detector for detecting scatter light from smoke in the detection chamber.

14. A method as claimed in claim 12, further comprising detecting the light from the pathways with a pathway detector for detecting light from the at least one pathways light sources.

15. A method as claimed in claim 11, wherein detecting the obstructions comprises comparing historical levels of light propagating through the pathways to current levels of light propagating through the one or more pathway to infer a degree of obstruction.

16. A fire detection system for performing self-testing of fire detection devices, comprising:

fire detection devices, each including:

a detection chamber in which indicators of fire are detected;

a baffle system surrounding the detection chamber for isolating the detection chamber while allowing air from an ambient environment to flow into the detection chamber through pathways; and a blockage sensor system for detecting obstructions in the pathways of the baffle system by detecting light propagating through the pathways;

a control panel that sends a test signal to the fire detection devices that activates the blockage sensor system, the control panel receiving analog values based levels of light propagating through the pathways and determining whether the values are indicative of the pathways being obstructed and generating an alert for cleaning and/or replacement in response to determining that the pathways are obstructed.

17. A system as claimed in claim 16, wherein the blockage sensor system comprises at least one pathway light source for shining the light into one or more of the pathways and a detector for detecting the light.

18. A system as claimed in claim 16, wherein the detection devices are scattered light detectors for detecting scatter light from smoke in the detection chamber.

19. A system as claimed in claim 16, wherein the control panel compares historical levels of light propagating through the pathways to current levels of light propagating through the pathways to infer a degree of obstruction.

* * * * *